US005932824A

United States Patent [19]

Liao

[11] Patent Number: 5,932,824

[45] Date of Patent: Aug. 3, 1999

[54] DRUM BEATER WITH A REPLACEABLE COUNTERWEIGHT

[75] Inventor: Tsun-Chi Liao, Taichung, Taiwan

[73] Assignee: Hwa Shin Musical Instrument Co., Ltd, Taichung, Taiwan

[21] Appl. No.: 08/947,631

[22] Filed: Oct. 9, 1997

[51] Int. Cl.[6] ..... G10D 13/02

[52] U.S. Cl. ..... 84/422.1

[58] Field of Search ..... 84/422.1, 422.2, 84/422.4

[56] References Cited

U.S. PATENT DOCUMENTS 1,343,164 6/1920 Smith ..... 84/422.1

*Primary Examiner*—Jeffrey W. Donels
*Attorney, Agent, or Firm*—Bacon & Thomas, PLLC

[57] ABSTRACT

A drum beater which includes a metal stem having one end coupled to a pedal driving mechanism of a bass drum and an opposite end fixedly mounted with a mounting block, a plastic beater body covered over the mounting block and a part of the metal stem, a rounded felt block fixedly fastened to a mounting hole at one end of the beater body and moved with it to beat the bass drum, a counterweight fitted into a receiving chamber at one end of the beater body remote from the rounded felt block, and a threaded fastening element inserted through an axial center through hole on the counterweight and threaded into an axial screw hole on the mounting block to fix the counterweight to the mounting block inside the beater body.

1 Claim, 6 Drawing Sheets

DRUM BEATER WITH A REPLACEABLE COUNTERWEIGHT

BACKGROUND OF THE INVENTION

The present invention relates to a drum beater for a bass drum, and more particularly to such a drum beater which is equipped with a replaceable counterweight.

FIG. 1 shows a drum beater coupled to a pedal driving mechanism and driven by it to beat a bass drum (not shown). The drum beater is comprised of a metal stem, and a hammer head fixedly fastened to one end of the metal stem. Because the hammer head is not heavy, it imparts less striking force to the bass drum when driven by the pedal driving mechanism. In order to positively beat the bass drum, the player must employ much effort to the pedal of the pedal driving mechanism.

SUMMARY OF THE INVENTION

The present invention has been accomplished to provide a drum beater which eliminates the aforesaid problem. It is the main object of the present invention to provide a drum beater which is equipped with a replaceable counterweight. According to the preferred embodiment of the present invention, the drum beater is comprised of a metal stem having one end coupled to a pedal driving mechanism of a bass drum and an opposite end fixedly mounted with a mounting block, a plastic beater body covered over the mounting block and a part of the metal stem, a rounded felt block fixedly fastened to a mounting hole at one end of the beater body and moved with it to beat the bass drum, a counterweight fitted into a receiving chamber at one end of the beater body remote from the rounded felt block, and a threaded fastening element inserted through an axial center through hole on the counterweight and threaded into an axial screw hole on the mounting block to fix the counterweight to the mounting block inside the beater body.

DETAILED DESCRIPTION OF THE PREFERRED EMBODIMENT

Figure 1:
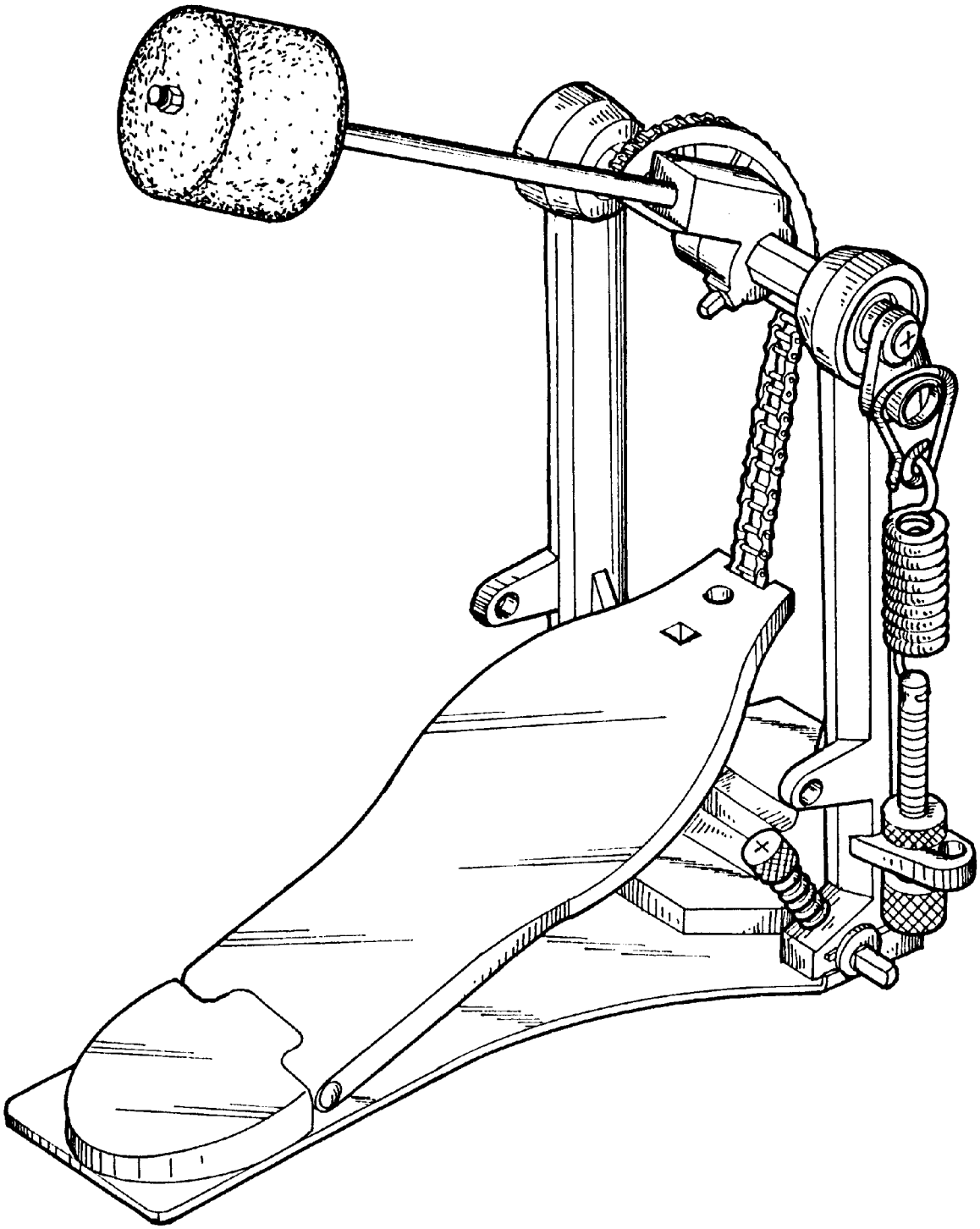
Fig. 1 PRIOR ART
FIG. 1 is a perspective assembly view of a pedal driving mechanism and a drum beater according to the prior art.
Figure 2:
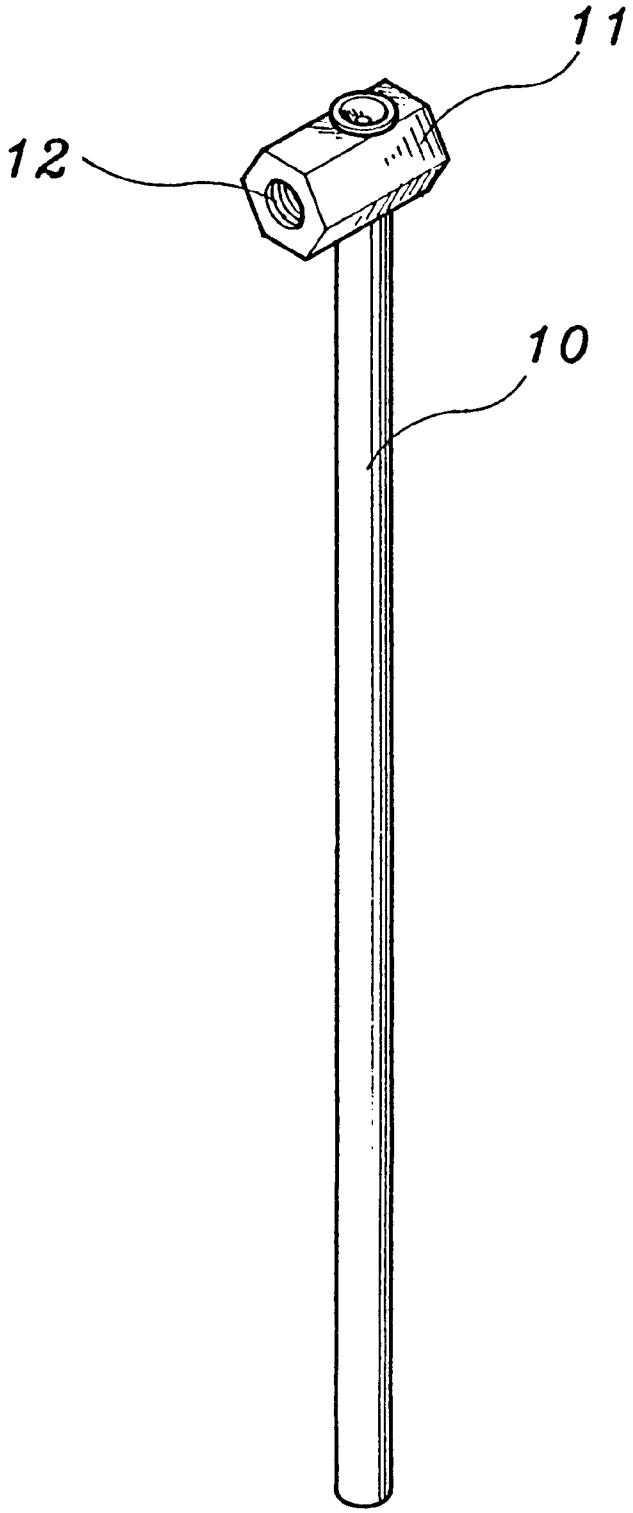
FIG. 2 is an elevational view a part of the present invention, showing the mounting block fixed to one end of the metal stem.
Figure 3:
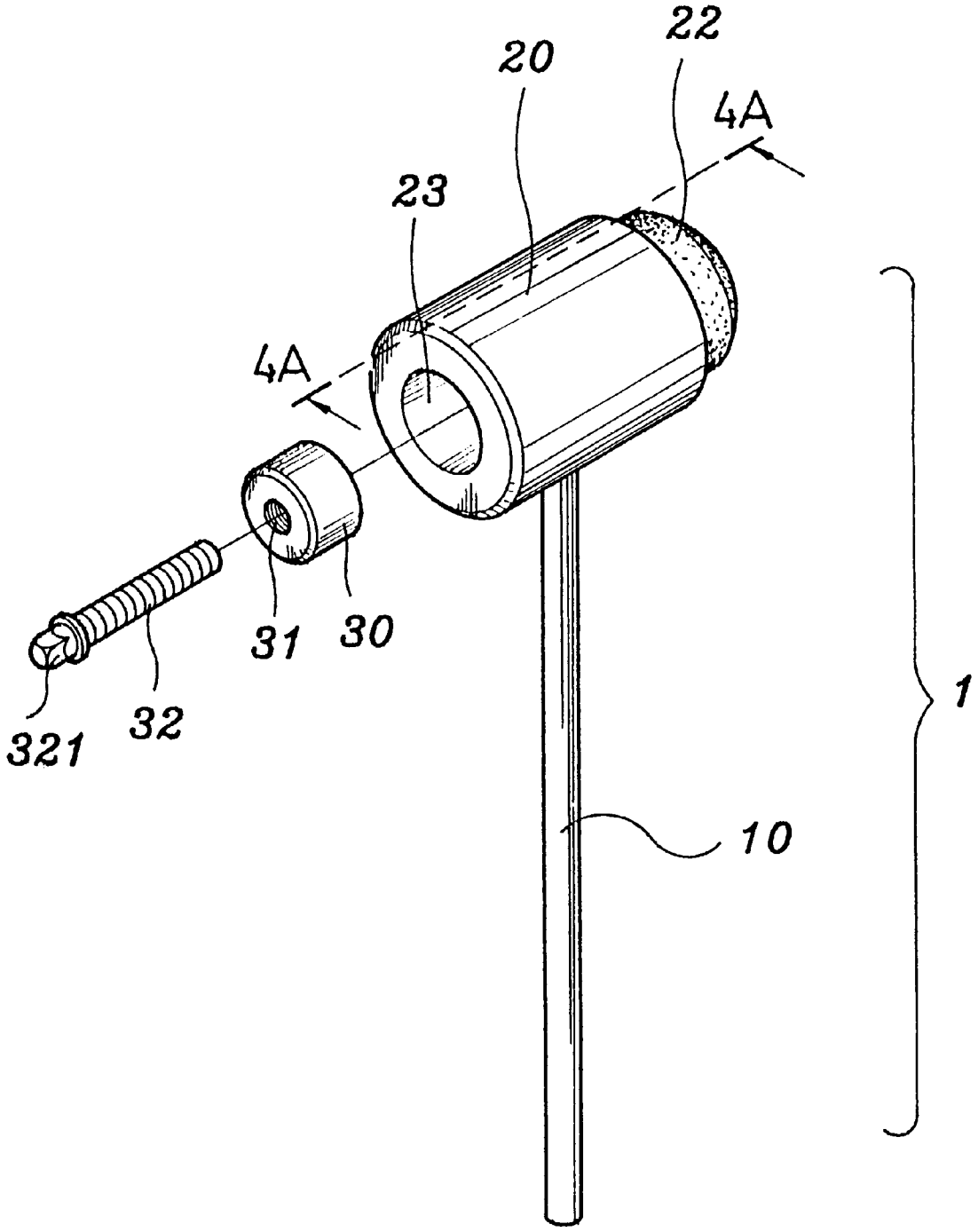
FIG. 3 is an exploded view of the drum beater according to the present invention.
Figure 4A:
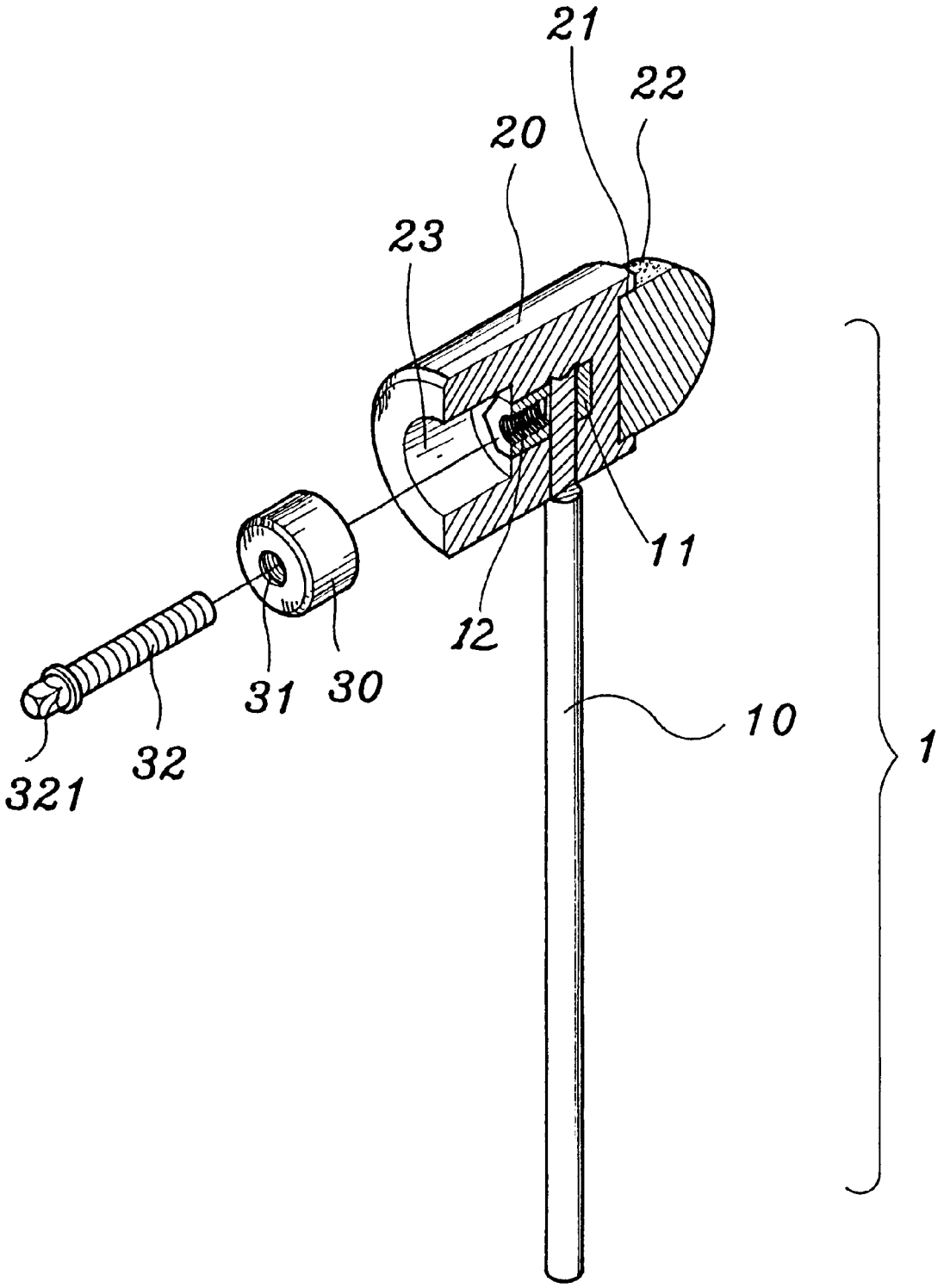
FIG. 4A is a sectional view taken along line 4A—4A of FIG. 3.

Referring to FIGS. 2, 3 and 4A, a drum beater 1 in accordance with the present invention is generally comprised of a metal stem 10, a polygonal mounting block 11, a beater body 20, a rounded felt block 22, a counterweight 30, and a threaded fastening element 32.

The polygonal mounting block 11 is perpendicularly and fixedly fastened to one end of the metal stem 10, having an axial screw hole 12. The beater body 20 is made from plastic, and directly molded on the polygonal mounting block 11 and a part of the metal stem 10 by injection molding. The beater body 20 comprises a cylindrical receiving chamber 23 at one end, which is axially aligned with the polygonal mounting block 11 and disposed in communication with the screw hole 12, and a mounting hole 21 at an opposite end. The rounded felt block 22 is fixedly fastened to the mounting hole 21 of the beater body 20, and serves as the striking face of the drum beater 1. The counterweight 30 is a cylindrical metal block having a predetermined weight and an axial center through hole 31. The outer diameter fits the cylindrical receiving chamber 23 of the beater body 20. The threaded fastening element 32 has a head 321 at one end. Through the head 321, the threaded fastening element 32 can be turned with a tool and threaded into the screw hole 12 of the polygonal mounting block 11 to fix the counterweight 30 to the polygonal mounting block 11 inside the beater body 20.

Figure 5:
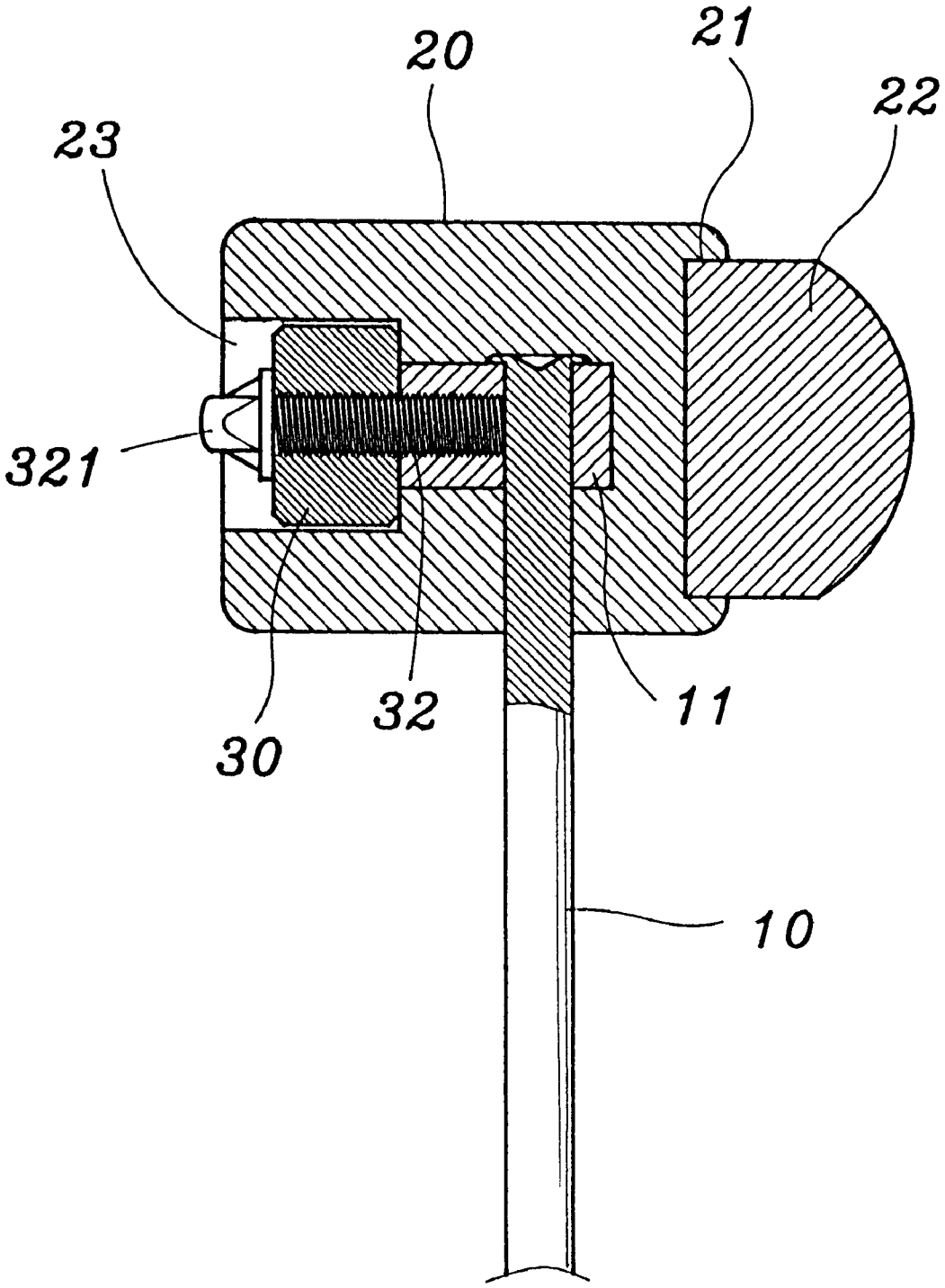
FIG. 5 is a sectional assembly view of the drum beater according to the present invention.
Figure 6:
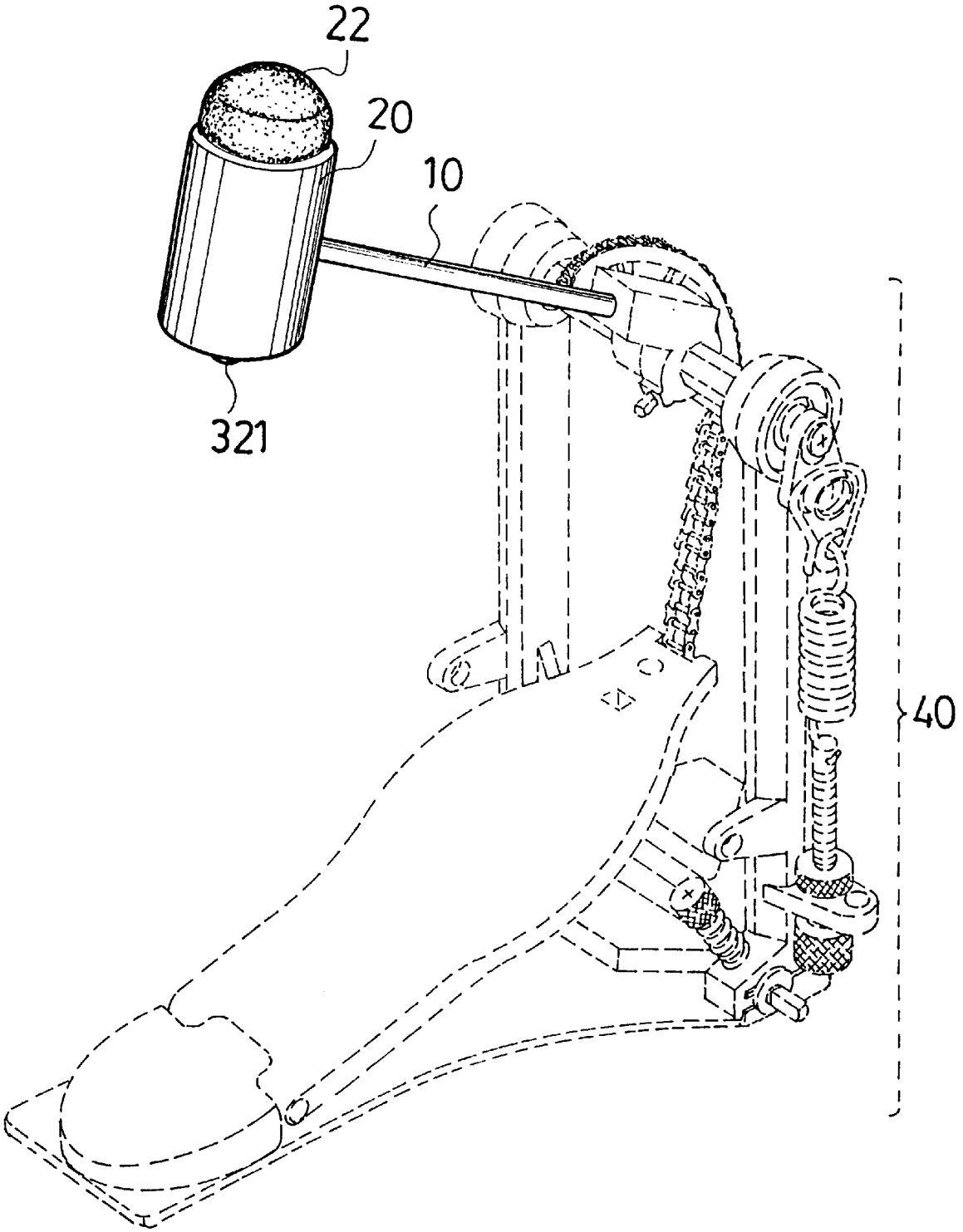
FIG. 6 shows the drum beater installed in a pedal driving mechanism according to the present invention.

Referring to FIGS. 5 and 6, when the counterweight 30 is fitted into the receiving chamber 23 of the beater body 20, the threaded fastening element 32 is inserted through the axial center through hole 31 of the counterweight 30 and threaded into the screw hole 12 of the polygonal mounting block 11L to fix the counterweight 30 to the polygonal mounting block 11 inside the beater body 20. When the threaded fastening element 32 is disconnected from the polygonal mounting block 11, the counterweight 30 can then be removed from the beater body 20 and the threaded fastening element 32 for a replacement, and the user can install a different weight of counterweight as desired. FIG. 6 shows the drum beater fastened to a pedal driving mechanism 40.

What I claim is:

1. A drum beater adapted for mounting on a pedal driving mechanism for beating a bass drum, comprising;

a metal stem coupled to a pedal driving mechanism of a bass drum;

a mounting block fixedly fastened to one end of said metal stem, said mounting block having an axial screw hole extending in a direction perpendicular to said metal stem;

a beater body covering said mounting block and a part of said metal stem, said beater body having first and second ends and comprising a receiving chamber at said first end which is axially aligned with said mounting block, said receiving chamber communicating with said axial screw hole, and said beater body further comprising a mounting hole at said second end;

a rounded felt block fixedly fastened to said mounting hole of said beater body and moved with said beater body to beat the bass drum;

a counterweight fitted into said receiving chamber of said beater body and stopped at one end of said mounting block, said counterweight having an axial center through hole disposed in alignment with said axial screw hole of said mounting block; and a threaded fastening element inserted through said axial center through hole of said counterweight and threaded into said axial screw hole of said mounting block to fix said counterweight to said mounting block inside said beater body.

* * * * *